United States Patent [19]

Binder et al.

[11] Patent Number: 4,660,512

[45] Date of Patent: Apr. 28, 1987

[54] AIR-COOLED MULTI-CYLINDER INTERNAL COMBUSTION ENGINE

[75] Inventors: Robert Binder, Schwieberdingen; Michael Beer, Wimsheim, both of Fed. Rep. of Germany

[73] Assignee: Raychem Corporation, Menlo Park, Calif.

[21] Appl. No.: 778,189

[22] Filed: Sep. 20, 1985

[30] Foreign Application Priority Data

Sep. 27, 1984 [DE] Fed. Rep. of Germany ..... 3435386

[51] Int. Cl.[4] ..... F01P 1/02

[52] U.S. Cl. ..... 123/41.6; 123/41.65; 123/41.69

[58] Field of Search ..... 123/41.6, 41.61, 41.62, 123/41.69, 41.7, 41.65

[56] References Cited

U.S. PATENT DOCUMENTS 1,683,602 9/1928 Brockway ..... 123/41.6

4,515,111 5/1985 Vosmeyer et al. ..... 123/41.61

FOREIGN PATENT DOCUMENTS 1026573 3/1958 Fed. Rep. of Germany ..... 123/41.6

986320 3/1965 United Kingdom ..... 123/41.6

*Primary Examiner*—William A. Cuchlinski, Jr.

*Attorney, Agent, or Firm*—Dennis E. Kovach; Ira D. Blecker

[57] ABSTRACT

An air-cooled multi-cylinder internal combustion engine includes cylinder heads cast together in a cylinder head casting; the cylinder heads are cooled from the inside by an S-shaped air flow extending between the valves. The cooling air thereby flows-in through an inlet channel at the inlet side of the cylinder heads, is deflected through 90° in a central connecting channel and after a once-more 90° deflection flows into the atmosphere through outlet channels which are formed between the individually cast exhaust gas outlet channels.

12 Claims, 5 Drawing Figures

3
4
5
6
7
8
9
10
11
12
13
14
15
16
17
18
20
21
22
23
24
25
26
27
28
29
32
33
36
37
38

AIR-COOLED MULTI-CYLINDER INTERNAL COMBUSTION ENGINE

The present invention relates to an air-cooled multi-cylinder internal combustion engine.

In an air-cooled four-valve internal combustion engine disclosed in the Swiss Pat. No. 233,261, an uninterrupted channel subdivided by cooling ribs is formed in the cylinder head, which extends between the two exhaust valves and the two inlet valves adjoining in the flow direction. Such a type of construction can be realized with advantage in individual cylinder heads. If, however, several cylinder heads are disposed in series one behind the other, then with such a longitudinal through-flow, the first cylinder head would be cooled well, however, the next-following cylinder head quite considerably more poorly because it is acted upon by the warmed-up cooling air of the first cylinder head. If one arranges the cylinder in such a manner that each cylinder head receives a cross through-flow according to the known type, then the structural volume of the internal combustion engine becomes very large in the longitudinal direction.

It is the object of the present invention to so constitute the air cooling system of the cylinder heads of a multi-cylinder internal combustion engine that its structural volume can be kept small and that all cylinder heads receive an equally good cooling.

The underlying problems are solved according to the present invention in that the cooling air flows into the cylinder heads through inlet channels at the inlet side, is deflected inside of the cylinder heads in the longitudinal direction of the internal combustion engine by connecting channels and after a further deflection flows out through outlet channels at the exhaust side of the cylinder heads. The S-shaped flow configuration of the cooling air which results from the double deflection signifies already from the geometry an increase of the surfaces of the cylinder head coming in contact with the cooling air, compared to a plain parallel through-flow, as a result of which a better heat removal is achieved. In order to be able to control this rate of air flow in a desired aimed-at manner and to be able to match the same to the operating conditions of the internal combustion engine, according to another feature of the present invention, the cooling air is supplied by a blower to the inlet channels whereby according to still another feature of the present invention, the blower and the inlet channels are covered off by an air guide housing which increases the blower efficiency and improves the forced through-flow of the inlet channels.

If for reducing the manufacturing costs and minimizing the structural volume three cylinder heads of a cylinder row are cast together into a single casting, the inlet channels of the two outer cylinder heads are appropriately located at the narrow end sides of the casting. After a 90° deflection about the valves, respectively, the guidances thereof, the air flow proceeds in both outer cylinder heads in opposite directions and is directed toward the middle cylinder head. After a deflection once-more, it flows out at the exhaust side of the cylinder head casting. In an embodiment of a four-valve type construction, the middle cylinder head receives two inlet channels disposed on both sides of the inlet channels and additionally two inlet openings disposed underneath the common connecting flange of the inlet channels. The overall inlet cross section is increased in this manner to such an extent that the air can be fed with only slight throttling and the middle cylinder head which is somewhat problematical from the point of view cooling, can be cooled as well as the two outer cylinder heads. Ideally uniform cooling conditions exist if two cylinder heads form a casting in which cooling air is introduced from both end faces. It is appropriate for this case to separate the cooling air flows of both cylinder heads by a cross wall.

In order to be able to make as large as possible the contact surfaces and the cross sections of the cooling channels during the outflow, the pipe-shaped outlet channels, between which are disposed the outlet surfaces of the cooling air, are cast individually.

These and other objects, features and advantages of the present invention will become more apparent from the following description when taken in connection with the accompanying drawing which shows, for purposes of illustration only, one embodiment in accordance with the present invention, and wherein.

Figure 1:
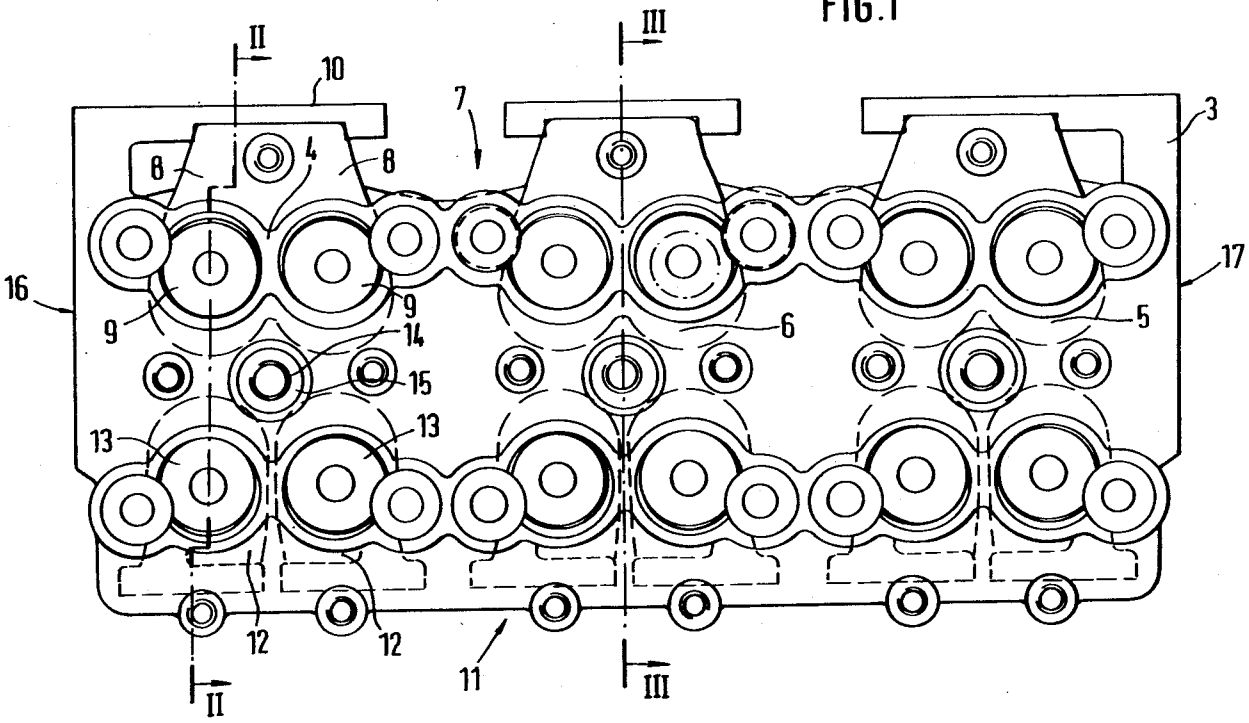
FIG. 1 is a plan view on a four-valve cylinder head casting of a six-cylinder boxer engine in accordance with the present invention with removed cam shaft housing.
Figure 2:
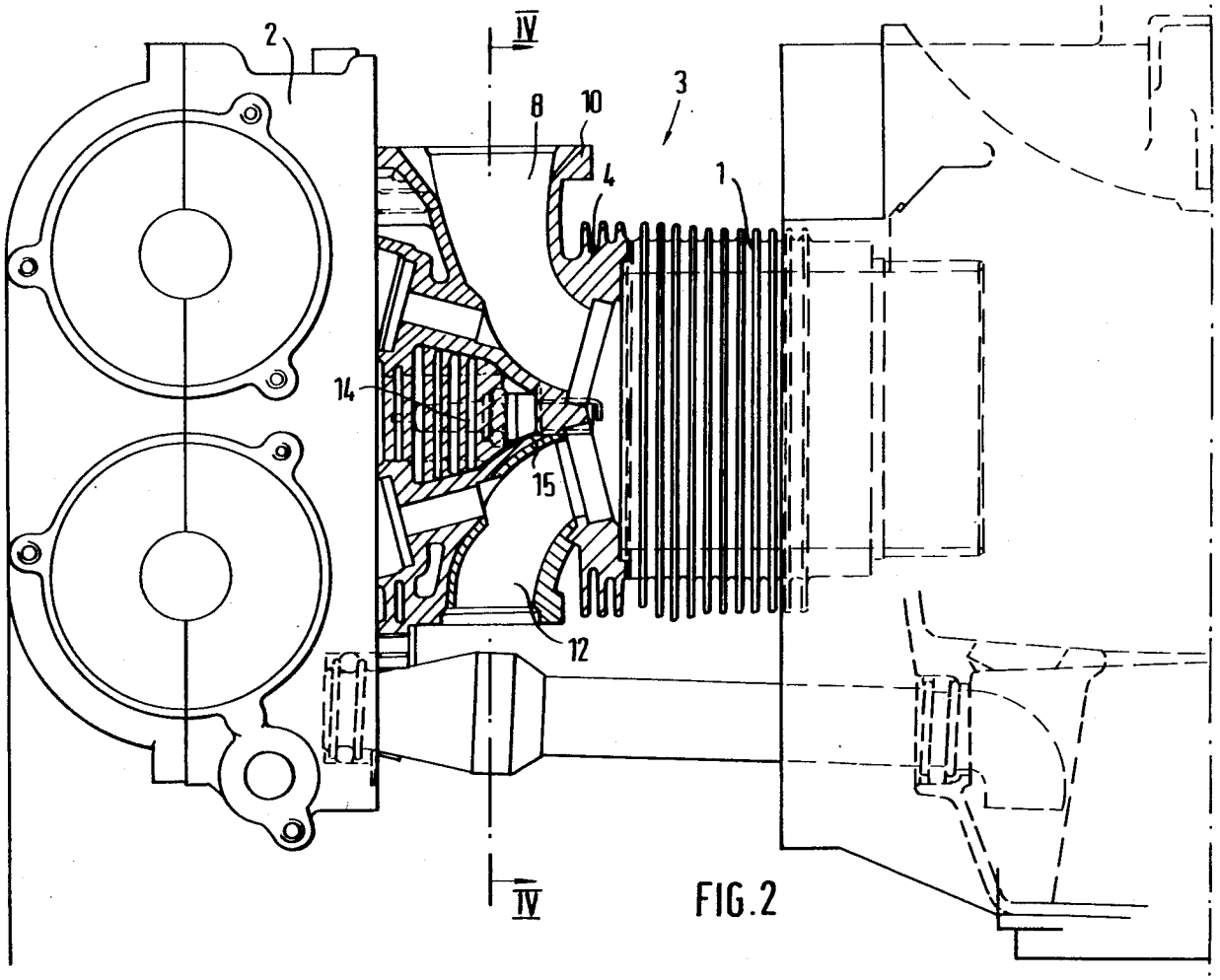
FIG. 2 is a cross-sectional view through the inlet valve and the exhaust valve of an outer cylinder head of the one cylinder row, taken along line II—II of FIG. 1.
Figure 3:
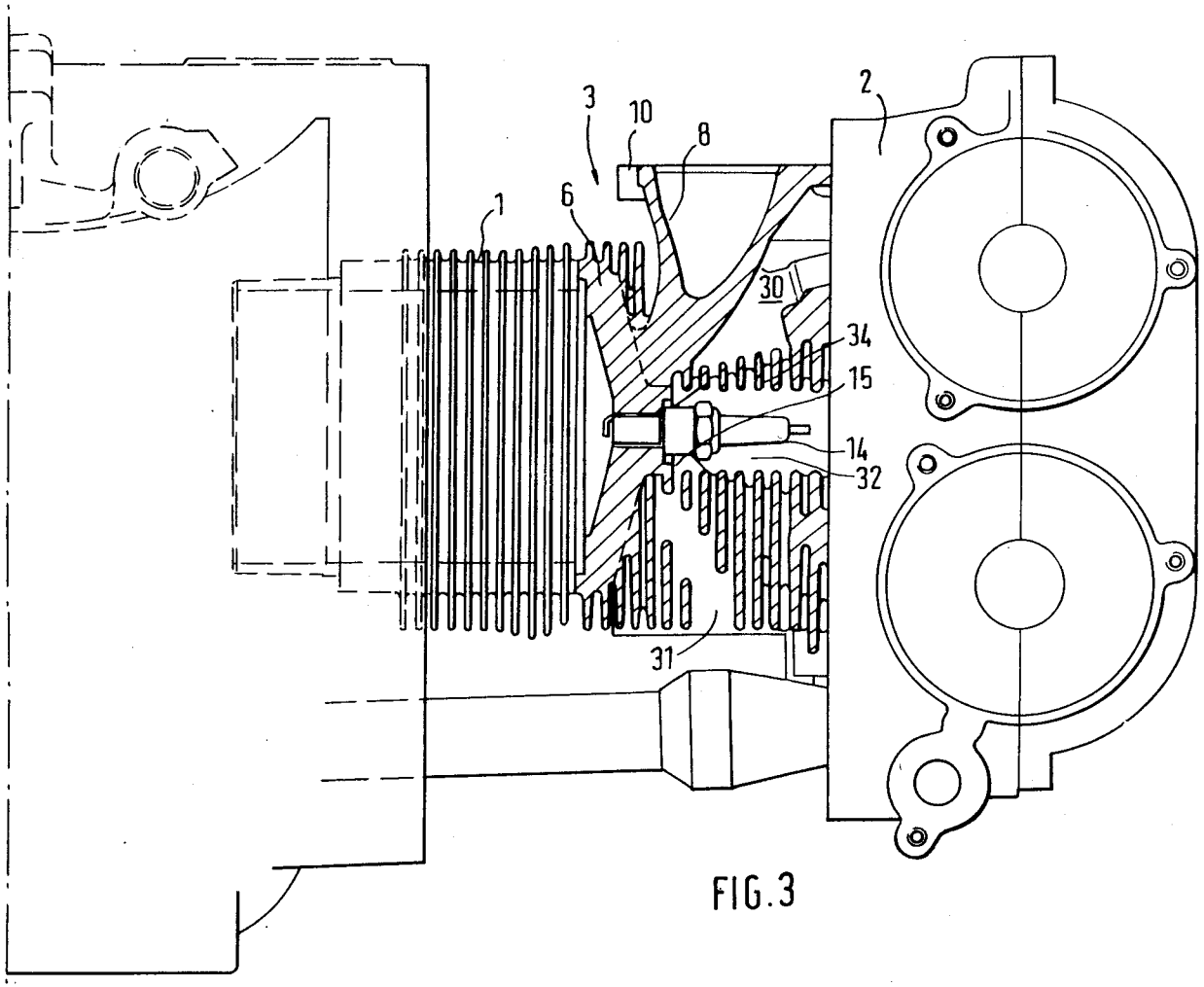
FIG. 3 is a cross-sectional view through the central spark plug of the middle cylinder head of the other cylinder row, taken along line III—III of FIG. 1.
Figure 4:
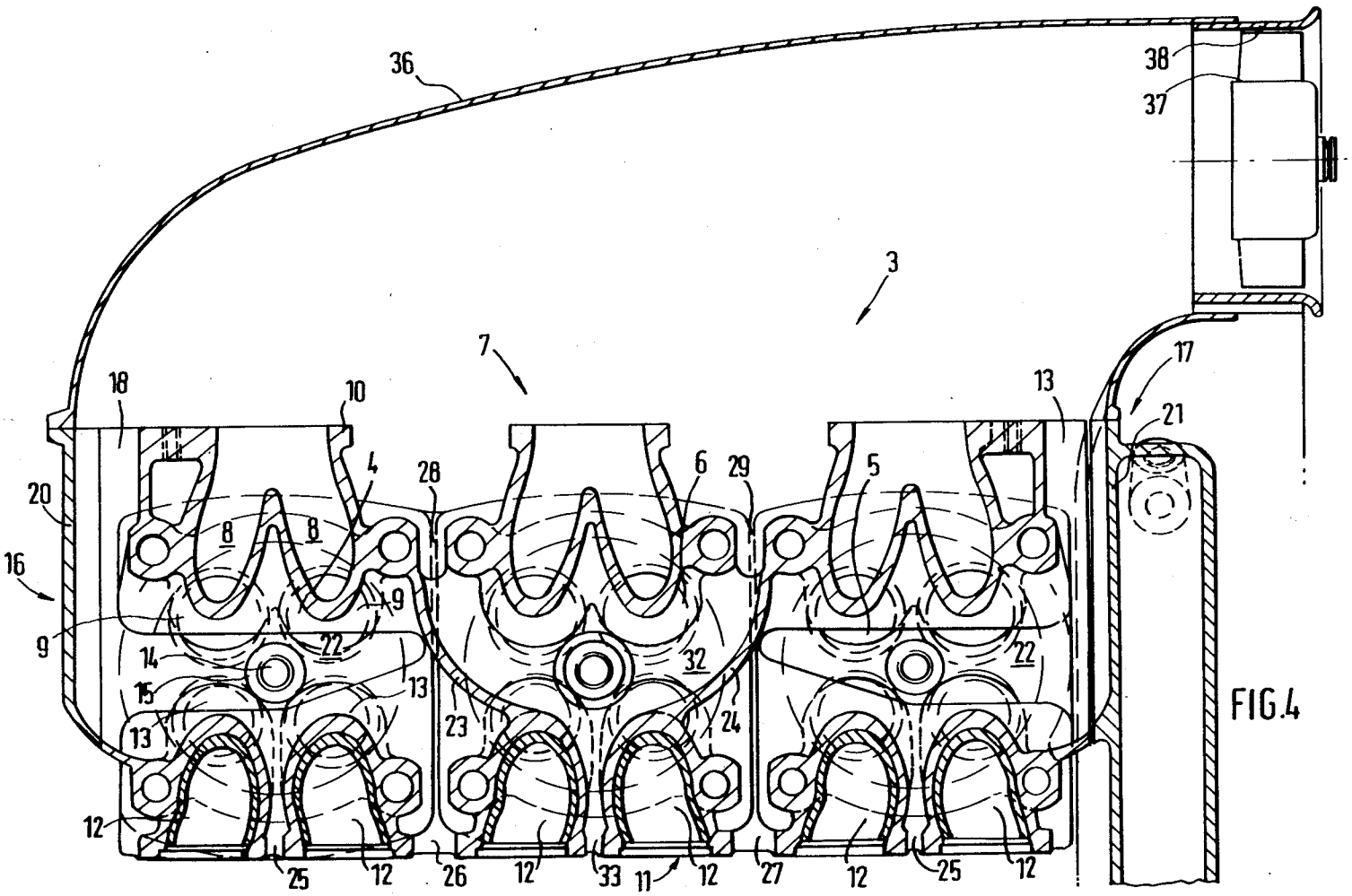
FIG. 4 is a longitudinal cross-sectional view of the cylinder head casting through the inlet and exhaust channels, taken along line IV—IV of FIG. 2.
Figure 5:
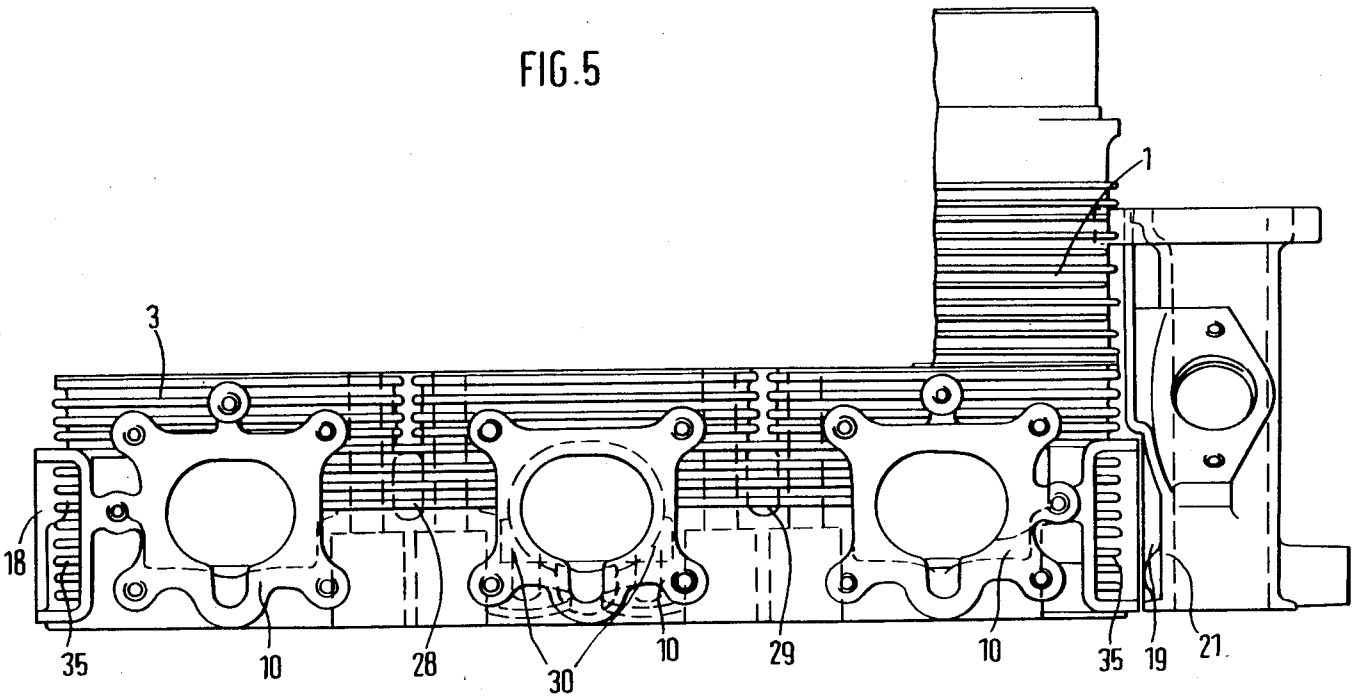
FIG. 5 is a plan view on the inlet side of the cylinder head casting according to FIG. 4.

Referring now to the drawing wherein like reference numerals are used throughout the various views to designate like parts, an air-cooled six-cylinder boxer engine with two inlet valves and two exhaust valves per cylinder, of which FIG. 2 illustrates the cross section of one cylinder row, is provided externally with circumferentially extending ribs for purposes of cooling. For the cooling on the inside of the cylinder head, a channel system is provided which is illustrated more clearly in FIG. 4.

A cylinder head casting generally designated by reference numeral 3 is arranged between the cylinder block 1 and a cam shaft housing 2, whereby the cross-sectional contour of the cylinder head casting 3 is approximately rectangular. The cylinder head casting 3 includes an outer cylinder head 4, a further outer cylinder head 5, as well as a middle cylinder head 6. Along its one longitudinal side—inlet side 5—two pipe-shaped inlet channels 8 leading to the two inlet valves 9 are cast-on for each cylinder head, which have a common connecting flange 10 to the air intake manifold (not shown). At the other longitudinal side—exhaust side 11—, each cylinder head includes two separately cast, pipe-shaped exhaust channels 12, through which the exhaust gas coming from the exhaust valve 13 flows off into the exhaust manifold.

The spark plug 14 is screwed into a spark plug mounting 15 centrally between the two inlet valves 9 and the two exhaust valves 13 which together form the points of a rectangle. Inlet channels 18 and 19 of the left and right cylinder head are formed along the narrow sides 16 and 17 of the cylinder head casting 3 transversely to the longitudinal dimension thereof, whereby a guide panel 20 serves as outside of the inlet channel 18, and the outside wall of a chain housing 21 serves as outside of the inlet channel 19. The inlet channels terminate in connecting channels 22 which extend in the longitudinal direction of the cylinder head casting 3 between the inlet valves 9 and exhaust valves 13. The flow branches off from the connecting channels 22 which are delimited by bent cross walls 23 and 24, into outlet channels 25 located between the exhaust channel 12 and into outlet channels 26 and 27 which are arranged at the exhaust side 11.

The cooling air flows to the middle cylinder head 6 through inlet channels 28 and 29 which are located at the inlet side 7 of the cylinder head casting 3 on both sides of the inlet valves 9 as well as by way of an inlet channel 30 provided underneath the connecting flange 10. These partial flows combine in the center connecting channel 32 which is adjoined by the outlet channel 33 extending between the exhaust channels 12. The cooling air channels are so dimensioned that the valves and spark plug mountings 15 of all three cylinder heads 4, 5 and 6 are kept at the same temperature level.

Rib systems 34 and 35, which project into the inlet channels and connecting channels for increasing the cooling surfaces, are cast-on at the channel walls.

The outlet channels 25 and 33 located between the exhaust channels 12 can have an only small cross section for structural reasons. In order not to further restrict the same, these outlet channels are without ribs in a partial area 31. An air guide housing 36 is mounted on the inlet side 5 of the cylinder head casting 3, into which a blower 37 supplies cooling air by way of a blower ring 38.

In addition to the air cooling, the cylinder block 1 and the cylinder head casting 3 may contain liquid-cooling channels within the area of the combustion space which, however, in that case are dimensioned quite small. Since one is able to get along in that case with little cooling liquid, an accurately controllable heat removal from the combustion space matched to the respective operating conditions can be achieved.

While we have shown and described only one embodiment in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. An air-cooled multi-cylinder internal combustion engine, comprising a cylinder head with two longitudinal sides forming an inlet side and an exhaust side, the cylinder head of a cylinder row forming a structural part, inlet channels leading to its inlet valves and exhaust channels leading away from the exhaust valves being cast-on at the inlet and exhaust side of the structural part, cooling air flowing into the cylinder head through inlet channel means at the inlet side, being deflected inside of the cylinder head in the longitudinal direction of the internal combustion engine by connecting channel means and, after a further deflection, flowing out through outlet channel means at the outlet side of the cylinder head, in which each cylinder row includes three cast-together cylinder heads, the cooling air being conducted into the two outer cylinder heads in two air streams at the two narrow sides of the three cast-together cylinder heads, the two air streams being deflected oppositely to one another in the direction toward the center cylinder head, being conducted between the valves and being guided into the atmosphere through two outlet channel means each at the exhaust side of the cylinder heads.

2. An internal combustion engine according to claim 1, further comprising blower means supplying cooling air to the inlet channel means by way of air guide means.

3. An internal combustion engine according to claim 2, wherein the inlet channel means and the blower means are surrounded by an air guide housing means.

4. An internal combustion engine according to claim 3, wherein the cooling air of the middle cylinder head is supplied through several inlet channel means and flows out through an outlet channel means located centrally at the cylinder head.

5. An internal combustion engine according to claim 4, wherein the cooling air streams of the two outer cylinder heads are separated from the cooling air stream of the middle cylinder head by cross walls.

6. An internal combustion engine according to claim 5, wherein the cross walls extend substantially symmetrically to the middle cross plane of the three cast-together cylinder heads.

7. An internal combustion engine according to claim 6, wherein each cylinder head includes two inlet and two exhaust valves and associated channels, the outlet channel means of the cooling air being constituted between the individually cast, pipe-shaped exhaust channels of the cylinder head.

8. An internal combustion engine according to claim 7, further comprising rib means protruding into the cooling channel means, the rib means being cast integrally in the channel walls.

9. An internal combustion engine according to claim 1, wherein the cooling air of the middle cylinder head means is supplied through several inlet channel and flows out through an outlet channel means located centrally at the cylinder head.

10. An internal combustion engine according to claim 1, wherein the cooling air streams of the two outer cylinder head are separated from the cooling air stream of the middle cylinder head by cross walls.

11. An internal combustion engine according to claim 10, wherein the cross walls extend substantially symmetrically to the middle cross plane of the three cast-together cylinder heads.

12. An air-cooled multi-cylinder internal combustion engine, comprising a cylinder head with two longitudinal sides forming an inlet side and an exhaust side, the cylinder head of a cylinder row forming a structural part, inlet channels leading to its inlet valves and exhaust channels leading away from the exhaust valves being cast-on at the inlet and exhaust side of the structural part, cooling air flowing into the cylinder head through inlet channel means at the inlet side, being deflected inside of the cylinder head in the longitudinal direction of the internal combustion engine by connecting channel means and, after a further deflection, flowing out through outlet channel means at the outlet side of the cylinder head, wherein each cylinder head includes two inlet and two exhaust valves and associated channels, the outlet channel of the cooling air being constituted between the individually cast, pipe-shaped exhaust channels of the cylinder head.

* * * * *

UNITED STATES PATENT AND TRADEMARK OFFICE

CERTIFICATE OF CORRECTION

PATENT NO. : 4,660,512
DATED : April 28, 1987
INVENTOR(S) : Robert Binder, Michael Beer It is certified that error appears in the above-identified patent and that said Letters Patent is hereby corrected as shown below:

On the title page:

Change item (73) Assignee to read:

Dr. Ing. h.c.F. Porsche
Aktiengesellschaft, Fed. Rep. of Germany

Change Attorney, Agent or Firm to read:

Barnes & Thornburg

Signed and Sealed this

Thirteenth Day of October, 1987

*Attest:*

DONALD J. QUIGG

*Attesting Officer*

*Commissioner of Patents and Trademarks*